US005693106A

United States Patent [19]

Peter-Hoblyn et al.

[11] Patent Number: 5,693,106

[45] Date of Patent: Dec. 2, 1997

[54] PLATINUM METAL FUEL ADDITIVE FOR WATER-CONTAINING FUELS

[75] Inventors: Jeremy D. Peter-Hoblyn, Bodwin, England; Barry N. Sprague, Bethlehem; James M. Valentine, Fairfield, both of Conn.

[73] Assignee: Platinum Plus, Inc., Stamford, Conn.

[21] Appl. No.: 372,188

[22] Filed: Jan. 13, 1995

Related U.S. Application Data

[63] Continuation-in-part of Ser. No. 251,520, May 31, 1994, Pat. No. 5,584,894, which is a continuation-in-part of Ser. No. 918,679, Jul. 22, 1992, abandoned.

[51] Int. Cl.[6] ..... C10L 1/32

[52] U.S. Cl. ..... 44/301; 44/354; 44/357

[58] Field of Search ..... 44/301, 354, 357

[56] References Cited

U.S. PATENT DOCUMENTS

| | | | |
|---|---|---|---|
| 2,086,775 | 7/1937 | Lyons et al. | 44/9 |
| 2,151,432 | 3/1939 | Lyons et al. | 44/9 |
| 2,402,427 | 6/1946 | Miller et al. | 44/57 |
| 4,295,816 | 10/1981 | Robinson | 431/4 |
| 4,629,472 | 12/1986 | Haney, III et al. | 44/301 |
| 4,891,050 | 1/1990 | Bowers et al. | 44/67 |
| 4,892,562 | 1/1990 | Bowers et al. | 44/67 |

FOREIGN PATENT DOCUMENTS

| | | |
|---|---|---|
| 2500683 | 1/1975 | Germany . |
| 9007561 | 7/1990 | WIPO . |

*Primary Examiner*—Jacqueline V. Howard

*Attorney, Agent, or Firm*—St. Onge Steward Johnston & Reens LLC

[57] ABSTRACT

Platinum group metal fuel additives are effective in fuel environments which make the exclusion of water impractical. The fuels additives comprise a platinum group metal compound and a water-functional composition selected from the group consisting of lipophilic emulsifiers, lipophilic organic compounds in which water is miscible and mixtures of these. The additives are preferably effective in fuel compositions having water contents of at least about 0.01% water by weight.

20 Claims, No Drawings

PLATINUM METAL FUEL ADDITIVE FOR WATER-CONTAINING FUELS

RELATED APPLICATIONS

This application is a continuation-in-part of commonly-assigned U.S. patent application entitled "The Reduction of Nitrogen Oxides From Diesel Engines" Ser. No. 08/251,520, filed in the names of J. Peter-Hoblyn and J. Valentine on May 31, 1994, now U.S. Pat. No. 5,584,894 which application is in turn a continuation-in-part of commonly assigned U.S. patent application entitled "The Reduction of Nitrogen Oxides From Vehicular Diesel Engines" Ser. No. 07/918,679, filed in the name of J. Valentine on Jul. 22, 1992 abandoned. The disclosures of both of these prior applications are hereby incorporated by reference in their entireties.

TECHNICAL FIELD

The invention relates to platinum group metal fuel additives, and particularly to the provision of economical additives of this type which are effective in fuel environments which make the exclusion of water impractical.

Fuel additives have been proposed over the years to improve fuel economy and reduce combustion exhaust pollutants such as carbon monoxide and unburned hydrocarbons. Some, including platinum group metal compounds, were found effective at relatively high levels in gasoline and diesel fuels. When attempting to formulate additives with economically-low levels of the platinum group metals, it was determined that even the small amounts of water naturally dispersed in gasoline and diesel fuels would cause the platinum group metal to precipitate and be lost for its purpose. In addition, some platinum group metal compounds tended to plate out more easily than others on the metal surfaces of fuel systems. The solution to both of these problems was the development of a group of fuel additives which were so highly soluble in the hydrocarbon fuel that they remained effectively in solution in the fuel until they were combusted to release the catalytic metal in low concentrations and in active catalytic form.

Unfortunately, experience has shown that producing the highly fuel-soluble forms of the platinum group metal compounds is extremely costly—in some cases costing more than any savings from reducing the required effective concentration of the platinum group metal compounds.

BACKGROUND ART

The art has developed a diversity of fuel additives for a wide variety of purposes. Those which offered the possibility of adding a small amount of a catalytic metal to achieve fuel economy have been most closely scrutinized. Related problems of engine wear, increased levels of pollutants, inactivation of catalytic converters, and others, were not always addressed. Some of the early technical contributions failed to identify the functional requirements necessary to assure effectiveness in the field. The more recent ones present technical requirements for the fuels and the catalytic compounds which, in many cases, are more costly than desired.

Among the early patents on catalytic metal fuel additives are U.S. Pat. No. 2,086,775 and U.S. Pat. No. 2,151,432 to Lyons and McKone, which disclose adding from 0.001 to 0.085% (i.e., from 10 to 850 parts per million) of an organometallic compound or mixture to a base fuel such as gasoline, benzene, fuel oil, kerosene, or blends to improve various aspects of engine performance. Among the metals disclosed in U.S. Pat. No. 2,086,775 are cobalt, nickel, manganese, iron, copper, uranium, molybdenum, vanadium, zirconium, beryllium, platinum, palladium, chromium, aluminum, thorium and the rare earth metals, such as cerium. Among those disclosed in U.S. Pat. No. 2,151,432 are selenium, antimony, arsenic, bismuth, cadmium, tellurium, thallium, tin, barium, boron, cesium, didymium, lanthanum, potassium, sodium, tantalum, titanium, tungsten and zinc. In both disclosures, the preferred organometallic compounds were beta diketone derivatives and their homologues, such as the metal acetylacetonates, proprionylacetonates, formylacetonates, and the like.

The Lyons and McKone disclosures state that concentrations of from 0.001 to 0.04% (i.e., from 10 to 400 parts per million) are not effective to improve combustion efficiency as introduced, but may become so upon prolonged use as catalytically active deposits are built up in the combustion chamber. The disclosures further state that about 0.01% (i.e., 100 ppm) of the organometallic compound is usually sufficient, once the requisite amount of catalytically active deposits has been build up, to perpetuate that amount of deposits by replacement of losses therefrom.

In Demonstration 15 in U.S. Pat. No. 2,086,775, palladium acetylacetonate was added to a fuel (not specifically identified, but presumably the leaded 65 octane gasoline employed in Demonstration 1) at a level of 0.002% (20 ppm). The level of palladium is found by calculation to be about 10 ppm.

U.S. Pat. No. 2,460,700 to Lyons and Dempsey, relates to water-soluble catalysts. A system is provided to inject aqueous solutions of them into the fuel line just in advance of combustion. The Lyons and catalysts are soluble in water or other "internal liquid coolants" such as alcohol, water-soluble glycols or aqueous solutions of these. Catalyst levels based on the weight of metal compounds no lower than 0.001% (10 ppm) are disclosed, and preferred levels are at least 1% of the weight of the operating fuel charge.

In U.S. Pat. No. 4,295,816, Robinson (like Lyons and Dempsey) discloses an elaborate delivery system for introducing water-soluble platinum group metal salts just before combustion. Robinson, however, delivers them through the air intake at a level no greater than 9 mg catalyst per kilogram of fuel. The equipment is, unfortunately, more complicated than would be desired.

In German Offenlegungschrift 2,500,683, Brantl discloses that a wide variety of catalytic metals may be added to hydrocarbon fuels to reduce nitrogen monoxide and oxidize carbon monoxide at the moment of combustion in internal combustion engines. The disclosure states that organometallic or Grignard compounds of the metals lithium, sodium, lead, beryllium, magnesium, aluminum, gallium, zinc, cadmium, tellurium, selenium, silicon, boron, germanium, antimony and/or tin can be added to the fuel individually or as a mixture. Similarly, the metal complexes of the metals scandium, titanium, vanadium, chromium, manganese, iron, cobalt, nickel, copper, zinc, ruthenium, rhodium, palladium, osmium, iridium, platinum, silver, gold, gallium, molybdenum, lead and mercury, with different ligands, can be added to the fuel individually or as a mixture. For the platinum group metals osmium, iridium, and platinum, broad concentrations of from 0.347 to 3.123 grams per liter of fuel are suggested for the various compositions listed in the disclosure, with the range for particularly favorable results being from 0.868 to 1.735 grams per liter of fuel. Considering the cost of these metals and the compositions containing them, there is a negative incentive for employing them at the high levels stated by the disclosure to be effective. Moreover, the tetramethyl platinum compound is not known to exist.

In U.S. Pat. No. 2,402,427, Miller and Lieber disclose the use of broad groupings of diesel-fuel-soluble organic and organometallic compounds as ignition promoters at concentrations of from 0.02 to 3% (i.e., 200 to 30,000 parts per million). Alkyl-metal nitrate compounds are exemplified by butyl-mecuric nitrate.

In U.S. Pat. Nos. 4,891,050 and No. 4,892,562 to Bowers and Sprague, it is disclosed that fuel-soluble platinum group metal compounds were effective at extremely low concentrations to improve fuel economy in gasoline and diesel engines, respectively. The preferred materials were specially formulated to include highly lipophilic groups in the molecules to improve fuel solubility.

In the commercial setting in which distillate fuels are transported, stored and sold, it is not practical to eliminate water from the fuel or their containment devices. For example, both diesel fuel and gasoline can have from between about 0.01 to about 0.5% water dispersed in it at the time of sale; and, the vehicle fuel tank may contain further water. In addition, some fuels, such as "gasohol", as formulated, contain significant amounts of water, and have an affinity for more. Other fuels having an affinity for water include some winter blends, especially those containing oxygenated hydrocarbons. In WO 90/07561 to Epperly, Sprague, Kelso and Bowers, it was disclosed that the relative affinity of the additive for water and fuel was an important consideration in selecting a platinum group metal fuel additive. This relative solubility, called the partition ratio, was expressed as the ratio of the amount in milligrams per liter of cplatinum group metal compound which is present in the fuel to the amount which is present in the water. High partition ratios, e.g., on the order of at least about 25 and preferably at least about 50 were taught.

It would be desirable to have a fuel additive based on a platinum group metal compound with could be prepared without utilizing expensive fuel-soluble compounds, but could achieve the same effectiveness as these compounds despite the presence of significant levels of water in the fuel.

DISCLOSURE OF INVENTION

It is an object of the invention to provide platinum group metal fuel additives which are effective in fuel environments which make the exclusion of water impractical.

It is another object of the invention to provide a fuel additive based on a platinum group metal compound that could be prepared without utilizing expensive fuel-soluble compounds, but could achieve the same effectiveness as these compounds despite the presence of significant levels of water in the fuel.

It is yet another object of the invention to provide fuel additives that solve the prior art problems with instability and the related increases in costs, to enable the simultaneous reduction of both unburned hydrocarbons (HC) and carbon monoxide (CO), preferably while maintaining or reducing $NO_x$ concentrations.

It is a further object of the invention to provide a fuel additive which mitigates the problems associated with the use of platinum metal additives.

It is a yet further object of the invention to provide a fuel additive based on platinum group metal compounds that reduce the need for producing the highly fuel-soluble forms of the platinum group metal compounds, thereby permitting water-sensitive compounds to be used at low concentrations.

The present invention achieves these and other objects by providing a fuel additive, a method for using the additives, and a fuel composition employing them.

The fuel additives of the invention will comprise a platinum group metal compound and a water-functional composition selected from the group consisting of lipophilic emulsifiers, lipophilic organic compounds in which water is miscible, and mixtures of these.

The fuel compositions of the invention comprise: a distillate fuel; and, a fuel additive comprising a platinum group metal compound and a water-functional composition selected from the group consisting of lipophilic emulsifiers, lipophilic organic compounds in which water is miscible, and mixtures of these.

The method of the invention comprises: adding to the fuel system of an internal combustion engine, a fuel composition comprising a distillate fuel and a fuel additive comprising a platinum group metal compound and a water-functional composition selected from the group consisting of lipophilic emulsifiers, lipophilic organic compounds in which water is miscible, and mixtures of these, said fuel composition within said fuel system having a water content of from about 0.01 to about 0.5% by weight; and, combusting the fuel composition within the engine.

DETAILED DESCRIPTION OF THE PREFERRED EMBODIMENT

In this description, the term "internal combustion engine" is meant to include all Otto and Diesel engines, for both mobile (including marine) and stationary powerplants and of the two-stroke per cycle, four-stroke per cycle and rotary types. The fuels are often referred to as "distillate fuels" even though they are not wholly comprised of distillates.

The distillate fuels are well known to those skilled in the art and usually contain a major portion of a normally-liquid fuel such as hydrocarbonaceous petroleum distillate fuel (e.g., motor gasoline as defined by ASTM Specification D-439-73, and diesel fuel). Such fuels can also contain non-hydrocarbonaceous materials such as alcohols, ethers, organo-nitro compounds and the like (e.g., methanol, ethanol, diethyl ether, methyl ethyl ether, nitromethane). These are also within the scope of this invention, as are liquid fuels derived from vegetable or mineral sources such as corn, alfalfa, shale, and coal. Examples of such fuel mixtures are combinations of gasoline and ethanol, (i.e., gasohol) diesel fuel and ether, gasoline and nitromethane, etc. Particularly preferred fuels are diesel fuel and gasoline.

The preferred fuel for admixture with the additive containing the platinum group metal compounds is diesel fuel or gasoline, and the additive containing the platinum group metal compounds can be added either to the fuel directly or to the lubricating oil in engines, such as two-stroke engines in which the oil is burned along with the fuel. In engines of this type, the oil can be introduced into the cylinders either in mixture with the fuel or separately injected into the engine. When the oil is added as part of the fuel, it will typically be blended at a ratio of from about 1:10 to about 1:75, e.g., from about 1:15 to about 1:25.

These fuels may also contain other additives which are well known to those skilled in the art. These can include anti-knock agents such as tetraalkyl lead compounds, lead scavengers such as halo-alkanes (e.g., ethylene dichloride and ethylene dibromide), dyes, cetane improvers, antioxidants such as 2,6-di-tertiary-butyl-4-methylphenol, rust inhibitors such as alkylated succinic acids and anhydrides, bacteriostatic agents, gum inhibitors, metal deactivators, upper cylinder lubricants, antiicing agents, and the like.

In a departure from conventional formulations, however, the fuels will preferably not include demulsifiers. It is a point of invention that the effects of the water on causing the precipitation of the platinum group metal can best be controlled by maintaining it tied up in the fuel, preferably in complete miscibility with a nonpolar fuel component or in droplets no larger than about 2μ, and preferably smaller than about 1μ in diameter, based on a weight average of droplets. Discrete pockets or pools of water, where the uniform distribution of the platinum group metal within the fuel is disturbed, should be avoided.

It is an advantage of the invention that the effective platinum group metal additive compounds need not be as highly fuel-soluble as the art has taught for best results. The effective platinum group metal compound can, however, comprise any of the petroleum-soluble organometallic platinum group metal coordination compounds discussed in or embraced by U.S. Pat. No. 4,891,050 and No. 4,892,562 to Bowers, et al., U.S. Pat. No. 5,034,020 to Epperly, et al., and U.S. Pat. No. 5,266,093 to Peter-Hoblyn, et al.

In addition to the highly fuel-soluble compounds taught by the art to be stable in the presence of water, the invention makes possible the use of platinum group metal compounds which would normally be taken up in any water present. These platinum group metal compounds can be either simply water-sensitive or essentially water-soluble. Water-sensitive platinum group metal compounds are characterized as being instable in the presence of from about 0.01 to about 0.5% water, but having sufficient affinity for the fuel that when a water-functional additive is employed in accordance with the invention, they remain in the fuel and effective for their intended catalytic function. The water-sensitive compounds typically have partition ratios of from about less than 50, down to about 1. Compounds of this type having partition ratios as low as 40 and below, e.g., less than 25, and more narrowly less than 1 to 20, can be effective according to the invention. Also, essentially water-soluble platinum group metal compounds having partition ratios of less than 1 can be employed according to the invention.

The fuel additives of the invention include a water-functional composition selected from the group consisting of lipophilic emulsifiers, lipophilic organic compounds in which water is miscible, and mixtures of these. The preferred compounds will have the capability of preventing frank separation of water from the fuel and will preferably maintain it tied up in the fuel, preferably in complete miscibility with a nonpolar fuel component or in droplets no larger than about 2μ, and preferably smaller than about 1μ in diameter, based on a weight average of droplet sizes. Discrete pockets or pools of water, where the uniform distribution of the platinum group metal within the fuel is disturbed, are preferably avoided.

In addition to the required components, it is preferred to employ a suitable hydrocarbon diluent such as any of the higher aliphatic alcohols (e.g., having over 3 carbons, i.e., from 3 to 22 carbons), tetrahydrofuran, methyl tertiarybutyl ether (MTBE), octyl nitrate, xylene, mineral spirits or kerosene, in an amount effective to provide a suitably pourable and dispersible mixture. Additionally, where the fuel additive is intended for use in an application where a commercially-available fuel can be expected to contain a demulsifier, then an additional amount of emulsifier specifically intended to overcome the effects of such can be employed. Also, the use of additives known to the art as described above and in the references there cited, can be employed as the application calls for. Specifically, it is sometimes desirable to add one or more of corrosion inhibitors, cetane improvers, octane improvers, lubricity control agents, detergents, antigel compositions, and the like.

The invention is seen to have wide application to gasoline and diesel fuels containing from about 0.01 to about 0.5% water as a contaminant (e.g., tramp water). However, consistent with the objective of the invention of controlling the tendency of water to render the platinum group metal compounds inactive, there are instances where the overt addition of water can be beneficial. It is a distinct advantage of the invention that overt addition of water, e.g., from about 1 to about 65%, can be accomplished without rendering the platinum group metal compounds inactive.

For example, fuel mixtures can be prepared as emulsions of diesel fuel and water, as mentioned above, but preferably including from about 5 to about 45% (more narrowly, 10 to 30%) water, for the purpose of controlling the amount of $NO_x$ produced during combustion. These emulsions can include a platinum group metal compound at a level of from about 0.1 to about 1.0% of the weight of the fuel mixture, to reduce the carbon monoxide and hydrocarbon emissions, and employing a lipophilic emulsifier at a ratio of from about 1:10,000 to about 1:500,000 (more narrowly, from about 1:50,000 to about 1:250,000) based on the weight of the platinum.

Also, there are instances wherein the use of complex emulsions (typically including a continuous hydrocarbon phase having dispersed therein droplets of water, which in turn have droplets of a lipophilic fluid dispersed therein). In one exemplary formulation of such a complex emulsion, the droplets of lipophilic fluid as the internally-dispersed phase can comprise the fuel additive, including the platinum group metal and the water-functional composition, e.g., a suitable emulsifier having the capability to maintain an emulsion of this type.

The emulsifiers effective for the complex emulsions will preferably contain a hydrophilic emulsifier such as higher ethoxylated nonyl phenols, salts of alkyl and alkyl ether sulfates, ethoxylated nonyl phenols with higher degrees of ethoxylation, higher polyethylene glycol mono- and diesters, and higher ethoxylated sorbitan esters (e.g., higher in these contexts means from a lower level of 4–6 to about 10 ormore). The fuel additive for use in preparing the complex emulsion preferably comprises a continuous hydrocarbon phase including a hydrophilic emulsifier at a concentration of from about 0.1 to about 10%, and a dispersed phase comprised of aqueous droplets having a platinum group metal compound dissolved or dispersed therein and a lipophilic emulsifier at a concentration of from about 0.1% to about 10% based on the weight of platinum group metal in the additive composition, said lipophilic emulsifier being charaterized by oil solubility and water dispersibility.

To better understand the above concept, the following exemplary procedure is presented: (1) The lipophilic emulsifier is added to the oil to be used for the internal phase at a ratio of from about 0.1 to about 10% of the total composition. Platinum group metal compounds may be dissolved or dispersed in this oil as desired. (2) The combined oil/lipophilic emulsifier just described is added to a solution of the hydrophilic emulsifier in water with stirring to form an oil-in-water emulsion. The concentration of hydrophilic emulsifier in the water is also between about 0.1 and 10% of the total composition. Water-soluble or dispersible platinum group metal compounds may be dispersed in the water as needed. (3) The oil-in-water emulsion described in step 2 is then added to oil containing the lipophilic emulsifier at a ratio of 0.1 to 10% of the total composition to form the final oil/water-in-oil emulsion.

Among the lipophilic emulsifiers suitable as the water-functional composition are, preferably, those emulsifiers having an HLB of less than about 10, and more preferably less than about 8. The term "HLB" means "hydrophile-lipophile balance" and is determined, as known from the procedure developed by ICI Americas, Inc. of Wilmington, Del., from a test of the relative solubility or dispersibility of the emulsifier in water, with nondispersible being 1–4 and fully dispersible being 13.

The emulsifier can be anionic, nonionic or cationic. Among the preferred anionic emulsifiers are sodium or TEA petroleum sulfonates, sodium dioctyl sulfosuccinates, and ammonium or sodium isostearyol 2-lactylates. Among the preferred cationic emulsifiers are lower ethoxylated amines, oleyl imidazolines and other imidazoline derivatives. Among the preferred nonionic emulsifiers are alkanolamides including oleamide, oleamide DEA, and other similar compounds, lower ethoxylated alkyl phenols, fatty amine oxides, and lower ethoxylated sorbitan esters (e.g., lower in these contexts means from 1 to an upper level of from about 4–6). Functionally, materials meeting the following criteria can be effective individually and in combinations to stabilize the presence of water-senstive and water-soluble platinum group metal compounds in water-containing systems. Concentrations will be dependent on the exact formulation and the expected water content of the fuel, but concentrations of from about 0.01 to about 5%, based on the weight of the fuel as combusted, and assuming a water concentration of up to about 0.05%, are among those preferred. In some cases, it is more meaningful to express the concentration on the basis of the platinum group metal, and in this case it is preferably at a ratio of from about 10:1 to about 500,000:1 as compared to the weight of platinum group metal in the additive composition.

It is sometimes preferred to employ a combination of emulsifiers, because the various hydrocarbons in the fuels interact differently with the same emulsifier. Often, individual emulsifiers are less effective than combinations due to interactions, including those between the fuel and the emulsifier. One exemplary combination of emulsifiers, referred to herein also as an emulsification system, which can be utilized comprises about 25% to about 85% by weight of an amide, especially an alkanolamide or n-substituted alkyl amine; about 5% to about 25% by weight of a phenolic surfactant; and about 0% to about 40% by weight of a difunctional block polymer terminating in a primary hydroxyl group. More narrowly, the amide can comprise about 45% to about 65% of the emulsification system; the phenolic surfactant about, 5% to about 15%; and the difunctional block polymer, about 30% to about 40% of the emulsification system.

Suitable n-substituted alkyl amines and alkanolamides are those formed by the condensation of, respectively, an alkyl amine and an organic acid or a hydroxyalkyl amine and an organic acid, which is preferably of a length normally associated with fatty acids. They can be mono-, di-, or triethanolamines and include any one or more of the following: oleic diethanolamide, cocamide diethanolamine (DEA), lauramide DEA, polyoxyethylene (POE) cocamide, cocamide monoethanolamine (MEA), POE lauramide DEA, oleamide DEA, linoleamide DEA, stearamide MEA, and oleic triethanolamine, as well as mixtures thereof. Such alkanolamides are commercially available, including those under trade names such as Clindrol 100-0, from Clintwood Chemical Company of Chicago, Ill.; Schercomid ODA, from Scher Chemicals, Inc. of Clifton, N.J.; Schercomid SO-A, also from Scher Chemicals, Inc.; Mazamide®, and the Mazamide series from PPG-Mazer Products Corp. of Gurnee, Ill.; the Mackamide series from Mcintyre Group, Inc. of University Park, Ill.; and the Witcamide series from Witco Chemical Co. of Houston, Tex.

The phenolic surfactant can be an ethoxylated alkyl phenol such as an ethoxylated nonylphenol or octylphenol. Especially preferred is ethylene oxide nonylphenol, which is available commercially under the tradename Triton N from Union Carbide Corporation of Danbury, Conn. and Igepal CO from Rhone-Poulenc Company of Wilmington, Del.

The block polymer which is an optional element of the emulsification system can comprise a nonionic, difunctional block polymer which terminates in a primary hydroxyl group and has a molecular weight ranging from about 1,000 to above about 15,000. Such polymers are generally considered to be polyoxyalkylene derivatives of propylene glycol and are commercially available under the tradename Pluronic from BASF-Wyandotte Company of Wyandotte, N.J. Preferred among these polymers are propylene oxide/ethylene oxide block polymers commercially available as Pluronic 17R1.

The emulsification system should be present at a level which will ensure effective emulsification of the water present, either alone or with a suitable lipophilic organic compound in which water is miscible (to be described in detail later). As an example, the emulsification system can be present at a level of at least about 0.05% by weight of the fuel to do so. Although there is no true upper limit to the amount of the emulsification system which is present, with higher levels leading to greater emulsification and for longer periods, there is generally no need for more than about 5.0% by weight, nor, in fact, more than about 3.0% by weight.

It is also possible to utilize a physical emulsion stabilizer in combination with the emulsification system noted above to maximize the stability of the emulsion. Use of physical stabilizers also provides economic benefits due to their relatively low cost. Although not wishing to be bound by any theory, it is believed that physical stabilizers increase emulsion stability by increasing the viscosity of immiscible phases such that separation of the oil/water interface is retarded. Exemplary of suitable physical stabilizers are waxes, cellulose products, and gums such as whalen gum and xanthan gum.

When utilizing both the emulsification system and physical emulsion stabilizers, the physical stabilizer is present in an amount of about 0.05% to about 5% by weight of the combination of chemical emulsifier and the physical stabilizer. The resulting combination emulsifier/stabilizer can then be used at the same levels noted above for the use of the emulsification system.

The emulsifiers are preferably blended with the platinum group metal compound and the resulting blend is then admixed with the fuel and emulsified. To achieve a stable emulsion, especially when large amounts of water are intended, a suitable mechanical emulsifying apparatus, such as an in-line emulsifying device, can be employed. Preferred emulsion stabilities will be for time periods of from about 10 days at a minimum to about 1 month or more. More preferably, the emulsion will be stable for at least 3 months.

Among the lipophilic organic compounds in which water is miscible, effective according to the invention, will be water-miscible, fuel-soluble compounds such as butanol, butyl cellosolve (ethyleneglycol monobutyl ether), dipropyleneglycol monometyl ether, 2-hexyl hexanol, diacetone alcohol, hexylene glycol, and diisobutyl ketone. Functionally, materials meeting the following criteria can be effective: that they have a water miscibility of at least about 10 g of water per liter of the material, and be soluble in the fuel (when the material contains the 10 g of water) in an amount of about at least 10 g per liter of total fuel. Additionally, the water functional composition will preferably be characterized by hydroxy, ketone, carboxylic acid funtional group, ether linkage, amine group, or other polar functional groups that can serve as water acceptors on a hydrocarbon chain. Concentrations will be dependent on the exact formulation and the expected water content of the fuel, but concentrations of from about 0.01 to about 1.0%, based on the weight of the fuel as combusted, are among those preferred. In some cases, it is more meaningful to express the concentration on the basis of the platinum group metal, and in this case it is preferably at a ratio of from about 1,000:1 to about 500,000:1 relative the weight of platinum group metal in the additive composition.

Platinum group metals include platinum, palladium, rhodium, ruthenium, osmium, and iridium. Compounds including platinum, palladium, and rhodium, especially compounds of platinum alone or possibly in combination with rhodium compounds are preferred on the basis of their relatively high vapor pressures.

Among the effective platinum group metal compounds are any of those effective to release catlytic platinum group metal in the combustion chamber. It is an advantage of the invention that water-soluble platinum group metal compounds, as well as those with varying degrees of solubility in hydrocarbon fuels, can be employed without the presence of water releasing the platinum from the fuel either by precipitation or by plating out on fuel storage or supply surfaces. These include compounds where the platinum group metal exists in oxidation states II and IV.

U.S. Pat. No. 4,891,050 to Bowers, et al., U.S. Pat. No. 5,034,020 to Eppedy, et al., and U.S. Pat. No. 5,266,093 to Peter-Hoblyn, et al., describe platinum group metal compounds which are highly-soluble in fuel and have high partition ratios. The entire disclosures of these patents are incorporated herein by reference for their descriptions of suitable platinum group metal compounds and procedures for preparing them. In addition to these materials, are commercially-available or easily-synthesized platinum group metal acetylacetonates, platinum group metal dibenzylidene acetonates, and fatty acid soaps of tetramine platinum metal complexes, e.g., tetramine platinum oleate. In addition, there are the water soluble platinum group metal salts such as chloroplatinic acid, sodium chloroplatinate, potassium chloroplatinate, iron chloroplatinate, magnesium chloroplatinate, manganese chloroplatinate, and cerium chloroplatinate, as well as any of those compounds identified or included within the description set forth by Haney and Sullivan in U.S. Pat. No. 4,629,472.

Typically, the platinum group metal compound will be employed in an amount sufficient to supply the platinum group metal within the range of from about 0.05 to about 2.0 milligrams of platinum group metal per liter of fuel, preferably from about 0.1 to about 1 milligrams of platinum group metal per liter of fuel. A more preferred range is from about 0.15 to about 0.5 milligrams of platinum group metal per liter of fuel.

Temperature stability of the additive is important in practical and operational terms. Typically, the breakdown temperature of the additive should be at least about 40° C., preferably at least about 50° C., in order to protect against most temperatures to which it can be expected to be exposed. In some circumstances, it will be necessary that the breakdown temperature be no lower than about 75° C.

The additive is also preferably substantially free from objectionable traces of, or functional groups containing, phosphorus, arsenic, and antimony (i.e., they should not contain a substantial amount of such functional groups) which have significant disadvantages like "poisoning" or otherwise reducing the effectiveness of the platinum group metal compound. Preferably, the purified platinum group metal additive compound contains no more than about 500 ppm (on a weight per weight basis) of phosphorus, arsenic, or antimony, more preferably no more than about 250 ppm. Most preferably, the additive contains no phosphorus, arsenic, or antimony.

Compounds including platinum, palladium, and rhodium, especially compounds of platinum alone or with one or more compounds of other catalytic metals are preferred in the practice of this invention.

In alternative embodiments the additives can be employed with other metallic compounds utilized for improving economy, reducing emissions of pollutants such as hydrocarbons and carbon monoxide, and for improving the operation of particulate traps or oxidationcatalysts. Among the useful metallic compounds are salts of manganese, iron, copper, cerium, sodium, lithium and potassium, which can be employed at suitable levels, e.g., from about 1 to about 100 ppm and preferably 30 to 60 ppm of the catalyst metal in combination with the platinum group metal composition in diesel fuels or gasoline. For gasoline engines, the manganese compounds are useful to improve fuel economy. For diesel engines, the manganese, iron, copper, cerium, sodium, and lithium compounds are effective to reduce the ignition temperature of particulates captured in a diesel trap. In combination with the platinum group metals it is possible to significantly reduce carbon monoxide and unburned hydrocarbons while removing particulates more easily from the trap. The above references and those cited therein are incorporated by reference to show specific salts and other compounds of these metals, including the acetonates, proprionylacetonates, and formylacetonates.

Among the suitable lithium and sodium compositions are the salts of lithium and sodium respectively, with suitable organic compounds such as alcohols or acids, e.g., aliphatic, alicyclic and aromatic alcohols and acids. Exemplary of particular salts are the lithium and sodium salts of tertiary butyl alcohol and mixtures of these. Other lithium and sodium organic salts are available and suitable for use to the extent that they are fuel-soluble and are stable in solution. While not preferred, inorganic salts can also be employed to the extent that they can be efficiently dispersed in the fuel, such as in a stable emulsion or otherwise.

Among the specific sodium compounds are: the salts of sulfonated hydrocarbons, for example sodium petroleum sulfonate, available as Sodium Petronate from Witco Chemical ($NaO_3SR$, R=alkyl, aryl, arylalkyl, and R is a hydrocarbon having greater than three carbons); sodium alcoholates, for example sodium t-butoxide and other fuel- soluble alkoxides (NaOR, wherein R is a lower alkyl, e.g., from 1 to 3 carbons; and sodium napthenate (sodium salts of napthenic acids derived from coal tar and petroleum). Among the specific lithium compounds are the lithium analogs of the above sodium compounds.

Among the specific cerium compounds are: cerium III acetylacetonate, cerium III napthenate, and cerium octoate and other soaps such as stearate, neodecanoate, and octoate (2-ethylhexoate). These cerium compounds are all trivalent compounds meeting the formula: $Ce(OOCR)_3$, wherein R=hydrocarbon.

Among the specific copper compounds are: copper acetylacetonate, copper napthenate, copper tallate, and soaps like stearate and the like including octoate and neodecanoate. These copper compounds are all divalent compounds, with the soaps meeting the formula: $Cu(OOCR)_2$. In addition, products of copper compounds with various organic substrates to form an organometallic complex as disclosed by Lubrizol patents such as International Publication Number WO 92/20764.

Among the specific iron compounds are: ferrocene, ferric and ferrous acetyl-acetonates, iron soaps like octoate and stearate (commercially available as Fe(III) compounds, usually), iron pentacarbonyl $Fe(CO)_5$, iron napthenate, and iron tallate.

Among the specific managanese compounds are: methylcyclopentadienyl manganese tricarbonyl ($CH_3C_5H_4$ MN $(CO)_3$, as described for example in U.S. Pat. No. 4,191,536 to Niebylski; manganese acetylacetonate, II and III valent; soaps including neodecanoate, stearate, tallate, napthenate and octoate.

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention which is defined by the following claims. For conciseness, several conventions have been employed with regard to listings of chemicals and ranges. The listings of chemical entities throughout this description are meant to be representative and are not intended to exclude equivalent materials, precursors or active species. Also, each of the ranges is intended to include, specifically, each integer, in the case of numerical ranges, and each species, in the case of chemical formulae, which is encompassed within the range. The claims are meant to cover the claimed components and steps in any sequence which is effective to meet the objectives there intended, unless the context specifically indicates the contrary.

We claim:

1. A fuel additive composition for providing a catalyst to the fuel and minimizing the degradation of catalytic activity by preventing the frank separation of water from the fuel and, thereby maintain the catalyst in the fuel, comprising:

a platinum group metal compound and a water-functional composition selected from the group consisting of lipophilic emulsifiers, lipophilic organic compounds in which water is miscible, and mixtures of these;

wherein said platinum group metal compound is present in an amount to provide from 0.05 to 2.0 milligrams of platinum per liter of fuel.

2. A fuel additive composition according to claim 1 wherein the platinum group metal compound is present in an amount sufficient to provide from about 0.1 to about 1.0 milligram of platinum group metal for each liter of fuel.

3. A fuel additive composition according to claim 1 wherein the water-functional composition comprises a lipophilic emulsifier at a ratio of from about 10:1 to about 500,000:1 based on the weight of platinum group metal in the additive composition.

4. A fuel additive composition according to claim 1 wherein the water-functional composition comprises a lipophilic organic compound in which water is miscible, said compound being present at a ratio of from about 10:1 to about 500,000:1 based on the weight of platinum group metal in the additive composition.

5. A fuel additive composition according to claim 4 wherein the water-functional composition additionally comprises a lipophilic emulsifier at a ratio of from about 10:1 to about 500,000:1 based on the weight of platinum group metal in the additive composition.

6. A fuel additive composition according to claim 1 wherein the fuel comprises a diesel fuel and contains from about 0.01 to about 0.5% water.

7. A fuel additive composition according to claim 1 wherein the fuel comprises gasoline and contains from about 0.01 to about 0.5% water.

8. A fuel additive composition according to claim 1 wherein the fuel comprises gasoline, diesel fuel or gasohol and contains from about 1.0 to about 15% water, and the platinum group metal composition exhibits a partition ratio of less than about 25.

9. A fuel additive composition according to claim 1 wherein the fuel comprises gasohol and contains from about 1.0 to about 15% water, and the water-functional composition comprises a lipophilic emulsifier at a ratio of from about 10:1 to about 500,000:1 based on the weight of platinum group metal in the additive composition.

10. A fuel additive composition according to claim 1 wherein the fuel comprises gasoline, diesel fuel or gasohol and contains from about 1.0 to about 15% water, and the water-functional composition comprises a lipophilic organic compound in which water is miscible, said compound being present at a ratio of from about 10:1 to about 500,000:1 based on the weight of platinum group metal in the additive composition.

11. A fuel additive composition according to claim 1 wherein the additive comprises a continuous hydrocarbon phase including a hydrophilic emulsifier at a concentration of from about 0.1 to about 10%, and a dispersed phase comprised of aqueous droplets having a platinum group metal compound dissolved or dispersed therein and a lipophilic emulsifier at a ratio of from about 10:1 to about 500,000:1 based on the weight of platinum group metal in the additive composition.

12. A fuel additive composition according to claim 1 wherein the additive further comprises from about 1 to about 100 ppm of a catalyst metal selected from the group consisting of manganese, iron, copper, cerium, sodium, and lithium compounds, in combination with the platinum group metal compound.

13. A fuel composition comprising:

a distillate fuel; and, a fuel additive comprising a platinum group metal compound present in an amount sufficient to provide from about 0.1 to about 1.0 milligram of platinum group metal for each liter of fuel and a water-functional composition selected from the group consisting of lipophilic emulsifiers, lipophilic organic compounds in which water is miscible, and mixtures of these.

14. A fuel composition according to claim 13 wherein the water-functional composition comprises a lipophilic emulsifier at a ratio of from about 10:1 to about 500,000:1 based on the weight of platinum group metal in the additive composition.

15. A fuel composition according to claim 13 wherein the water-functional composition comprises a lipophilic organic compound in which water is miscible, said compound being present at a ratio of from about 10:1 to about 500,000:1 based on the weight of platinum group metal in the additive composition.

16. A fuel composition according to claim 13 wherein the additive further comprises from about 1 to about 100 ppm of a catalyst metal selected from the group consisting of manganese, iron, copper, cerium, sodium, and lithium compounds, in combination with the platinum group metal compound.

17. A fuel composition according to claim 13 wherein the additive comprises a continuous hydrocarbon phase including a hydrophilic emulsifier at a concentration of from about 0.1 to about 10%, and a dispersed phase comprised of aqueous droplets having a platinum group metal compound dissolved or dispersed therein and a lipophilic emulsifier at a ratio of from about 10:1 to about 500,000:1 based on the weight of platinum group metal in the additive composition.

18. A method for operating an internal combustion engine comprising:

adding to the fuel system of an internal combustion engine, a fuel composition comprising a distillate fuel and, a fuel additive comprising a platinum group metal compound the platinum group metal compound is present in an amount sufficient to provide from about 0.1 to about 1.0 milligram of platinum group metal for each liter of fuel, and a water-functional composition selected from the group consisting of lipophilic emulsifiers, lipophilic organic compounds in which water is miscible and mixtures of these, said fuel composition within said fuel system having a water content of at least about 0.01% water by weight; and combusting the fuel composition within the engine.

19. A method according to claim 18 wherein the water-functional composition comprises a lipophilic organic compound in which water is miscible, said compound being present at a ratio of from about 10:1 to about 250,000: based on the weight of platinum group metal in the additive composition.

20. A method according to claim 18 wherein the water-functional composition comprises a lipophilic emulsifier at a ratio of from about 10,000 to about 250,000 based on the weight of platinum group metal in the additive composition.

* * * * *